US009010357B2

(12) United States Patent
Vogler et al.

(10) Patent No.: US 9,010,357 B2
(45) Date of Patent: Apr. 21, 2015

(54) WICKER HOSE REEL ENCLOSURE

(75) Inventors: Michael R. Vogler, Oswego, IL (US); Brian C. Donnelly, Naperville, IL (US); Michael Thuma, La Grange, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 577 days.

(21) Appl. No.: 13/110,305

(22) Filed: May 18, 2011

(65) Prior Publication Data

US 2012/0291882 A1 Nov. 22, 2012

(51) Int. Cl.

| | |
|---|---|
| ***B65H 75/38*** | (2006.01) |
| ***B65D 43/06*** | (2006.01) |
| ***B65D 43/16*** | (2006.01) |
| ***B65H 75/40*** | (2006.01) |
| ***B65H 75/44*** | (2006.01) |

(52) U.S. Cl.

CPC ..... *B65H 75/40* (2013.01); *B65H 75/4407* (2013.01); *B65H 75/4471* (2013.01); *B65H 2701/33* (2013.01)

(58) Field of Classification Search

CPC ..... B65H 75/4478; B65H 2701/33
USPC ..... 137/355.26, 355.27, 355.12, 137/355.16–355.25, 355.28; 220/676, 810, 220/836, 845

See application file for complete search history.

(56) References Cited

U.S. PATENT DOCUMENTS

| | | | | |
|---|---|---|---|---|
| 2,747,388 | A * | 5/1956 | Dolar | 220/524 |
| 5,190,152 | A * | 3/1993 | Smith et al. | 206/425 |
| 6,050,291 | A | 4/2000 | Whitehead et al. | |
| 6,338,360 | B2 | 1/2002 | Spear et al. | |
| 6,742,740 | B2 * | 6/2004 | Tisbo et al. | 137/355.26 |
| 6,877,687 | B2 | 4/2005 | Moon et al. | |
| 7,360,748 | B2 | 4/2008 | Rosine et al. | |
| 7,581,705 | B2 | 9/2009 | Rosine et al. | |
| 7,658,358 | B2 | 2/2010 | Rosine et al. | |
| 2010/0037565 | A1 * | 2/2010 | Meissen | 53/492 |

* cited by examiner

*Primary Examiner* — Craig Schneider
*Assistant Examiner* — Jonathan Waddy
(74) *Attorney, Agent, or Firm* — McHale & Slavin P.A.

(57) ABSTRACT

A hose reel enclosure for use with a flexible hose includes a hose reel rotatably mounted within the enclosure. A hand crank is mounted on one of the side walls and secured to the reel. A water inlet is mounted on another side wall. The water inlet is secured to a water coupling which is rotatably mounted within the hose reel. A hose guide is mounted in an aperture in a front wall of the enclosure. The hose guide enables a hose to be played out and wound onto the reel within the enclosure. The top cover of the enclosure includes two sections. A first section is secured to the enclosure and remains stationary. A second section is pivotally secured to the side walls of the enclosure and permits access to the interior of the enclosure. The exterior of the enclosure is covered with an aesthetically pleasing design such as a wicker fabric.

15 Claims, 14 Drawing Sheets

WICKER HOSE REEL ENCLOSURE

FIELD OF THE INVENTION

This invention relates to reels for use in the storage of flexible hoses, and more particularly to a hose reel storage enclosure which is aesthetically pleasing.

BACKGROUND OF THE INVENTION

Portable hose dispensers for handling and storage of flexible water hoses, such as garden and air hoses, have gained wide public acceptance. While, the construction of hose dispensers is quite varied, they are primarily constructed as a reel or spool rotatably mounted to a support. They are primarily constructed of molded plastic components having a centrally disposed rotatable spool or reel for reeling of the flexible hose, and a frame for supporting of the spool. Initially, hose dispensers were portable, wheeled carts. The hose was stored on a rotatable spool which enabled the hose to be easily removed from the spool and returned thereto.

Although such carts have become widespread in use because of their neat and orderly storage capabilities, they do have their drawbacks. First, a hose stored on such a reel is open to the environs. Often hoses are made from rubber or similar materials that can become stiff or brittle and can break when subjected to low temperature extremes. This becomes more of a problem as the hoses age. In addition, ultra-violet radiation has been known to accelerate degradation of many of these materials.

Moreover, hose reel carts may be considered by some to be unsightly. As such, some users may be inclined to constantly remove the hose reel cart from the location where it is in use. Particularly from the front of a house. This can be exaggerated when, for example, the cart becomes dirty, muddy and the like. Given that most hose reel carts are designed for use in and around garden and lawn areas, it can be expected for these carts to become dirty and unsightly.

Accordingly, there exists a need for a hose reel storage device that permits a hose to be taken up and dispensed readily and is aesthetically pleasing. That is, such a hose reel storage device can be used to "hide-away" the hoses stored therein when not in use and desirably provide a protective, outwardly aesthetically pleasing appearance.

DESCRIPTION OF THE PRIOR ART

U.S. Pat. No. 6,050,291 discloses an enclosed hose reel for use with an associated hose. The enclosure houses a spool which carries the hose thereon. A hinged top cover permits ready access to the hose within the enclosure. A handle positioned on one of the side walls of the enclosure is directly connected to the spool. The handle enables an individual to readily wind the hose onto the spool for storage within the enclosure. An aperture in a front wall of the enclosure enables the hose to be played out and retrieved without the cover being lifted.

U.S. Pat. No. 6,877,687 discloses a hose reel enclosure including a powered hose rewinding device. The hose reel is rotatable by either a direct current powered motor or a folding manual crank. Power from the electric motor is transferred to the reel via an infinitely adjustable torque transfer assembly. When the cover of the enclosure is in the open position, the direct current motor is operatively locked out and when the cover is in the closed position, the direct current motor is operable.

U.S. Pat. No. 6,338,360 discloses a portable hose reel carrier comprising a wheeled structure having spaced apart walls and a top wall covering a receptacle. A hose reel is rotatably mounted between side walls and is rotated by a hand crank operated outside one of the side walls. A reciprocating hose guide which guides the hose onto and from the hose reel is also operated by the hand crank.

U.S. Pat. Nos. 7,360,748, 7,581,705, and 7,658,358 disclose a rotatable base for use with a hose reel enclosure. The base comprises an upper and a lower portion. A bearing is located between the upper and lower portions and permits the portions to rotate with respect to each other. Clips are provided on the upper portion to permit a hose reel enclosure to be removably secured thereto.

SUMMARY OF THE INVENTION

An enclosed hose reel for use with a flexible hose includes a hose reel rotatably mounted within the enclosure. The reel is secured between two of the side walls of the enclosure. A hand crank is mounted on one of the side walls and secured to the reel. A water inlet is mounted on another side wall. The water inlet is secured to a water coupling which is rotatably mounted within the hose reel. A hose guide is mounted in an aperture in a front wall of the enclosure. The hose guide enables a hose to be played out and wound onto the reel within the enclosure. The top cover of the enclosure includes two sections. A first section is secured to the enclosure and remains stationary. A second section is pivotally secured to the side walls of the enclosure and when raised permits access to the interior of the enclosure. The exterior of the enclosure is covered with an aesthetically pleasing design such as a wicker fabric.

Accordingly, it is an objective of the present invention to provide a hose reel enclosure which is aesthetically pleasing and resistant to weathering.

It is a further objective of the present invention to provide a hose reel enclosure which is made from components that are able to withstand continual exposure to the environment.

It is still a further objective of the present invention to provide a hose reel enclosure which is made from panels formed by injection molding which provide increased structural integrity to the enclosure.

It is a still further objective of the present invention to provide a hose reel enclosure which includes a cover assembly that provides structural support to the enclosure.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
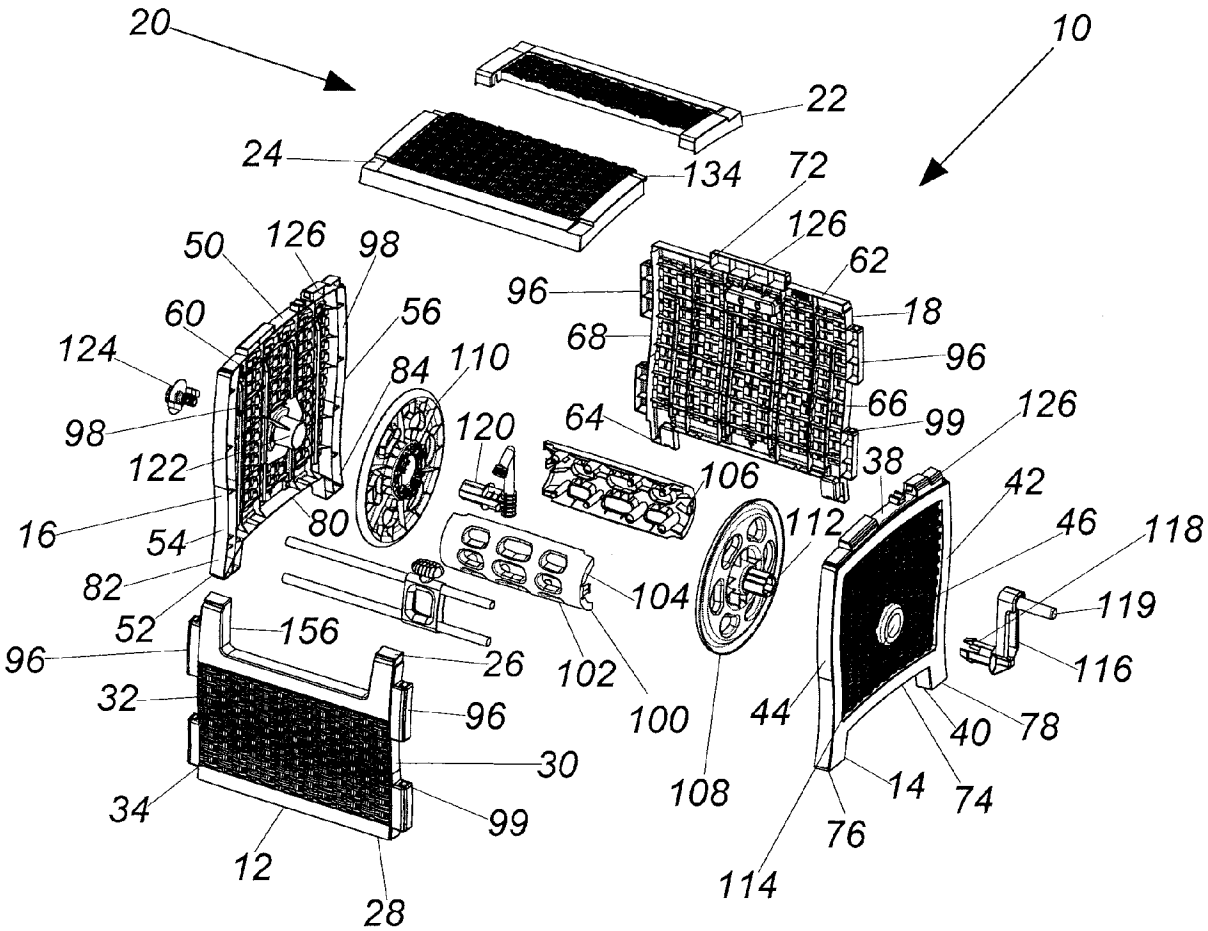
FIG. 1 is an exploded view of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
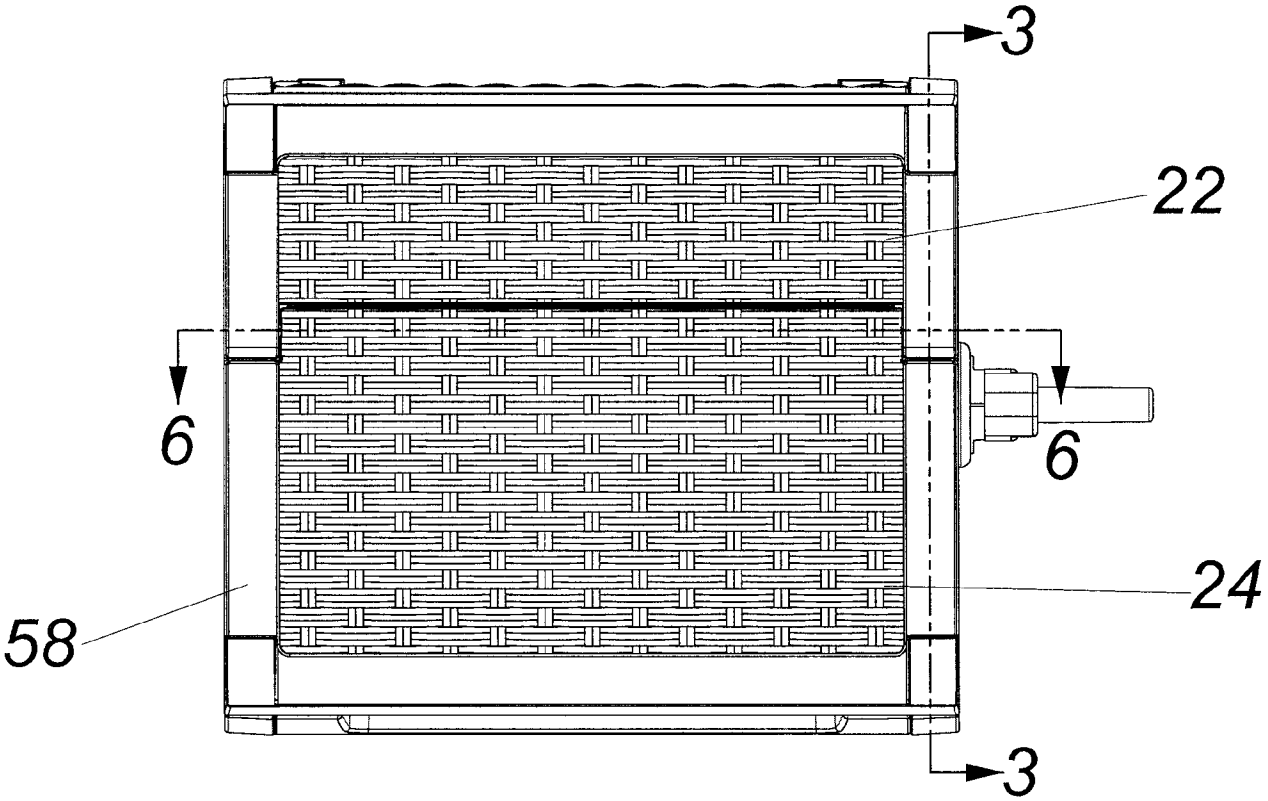
FIG. 2 is a top view of the present invention.
Figure 3:
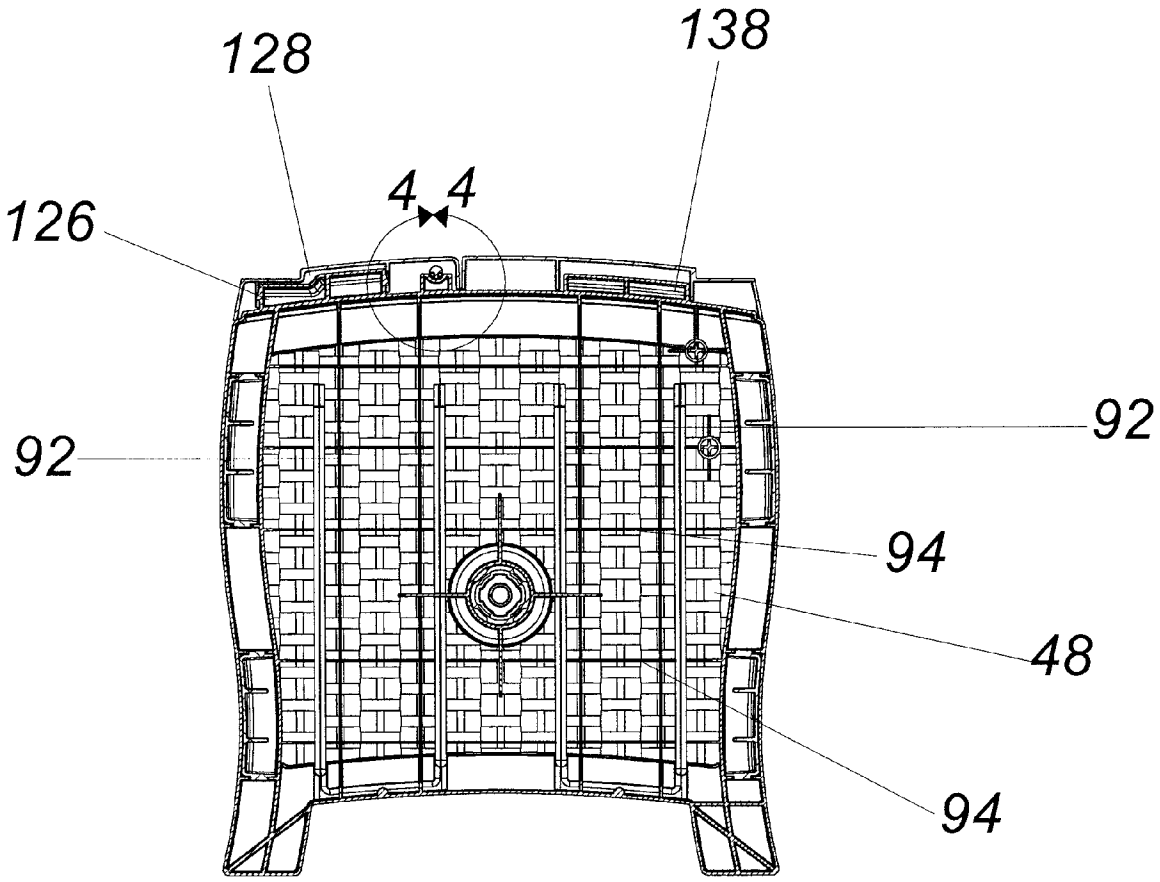
FIG. 3 is a sectional view of FIG. 2 along line 3-3.
Figure 6:
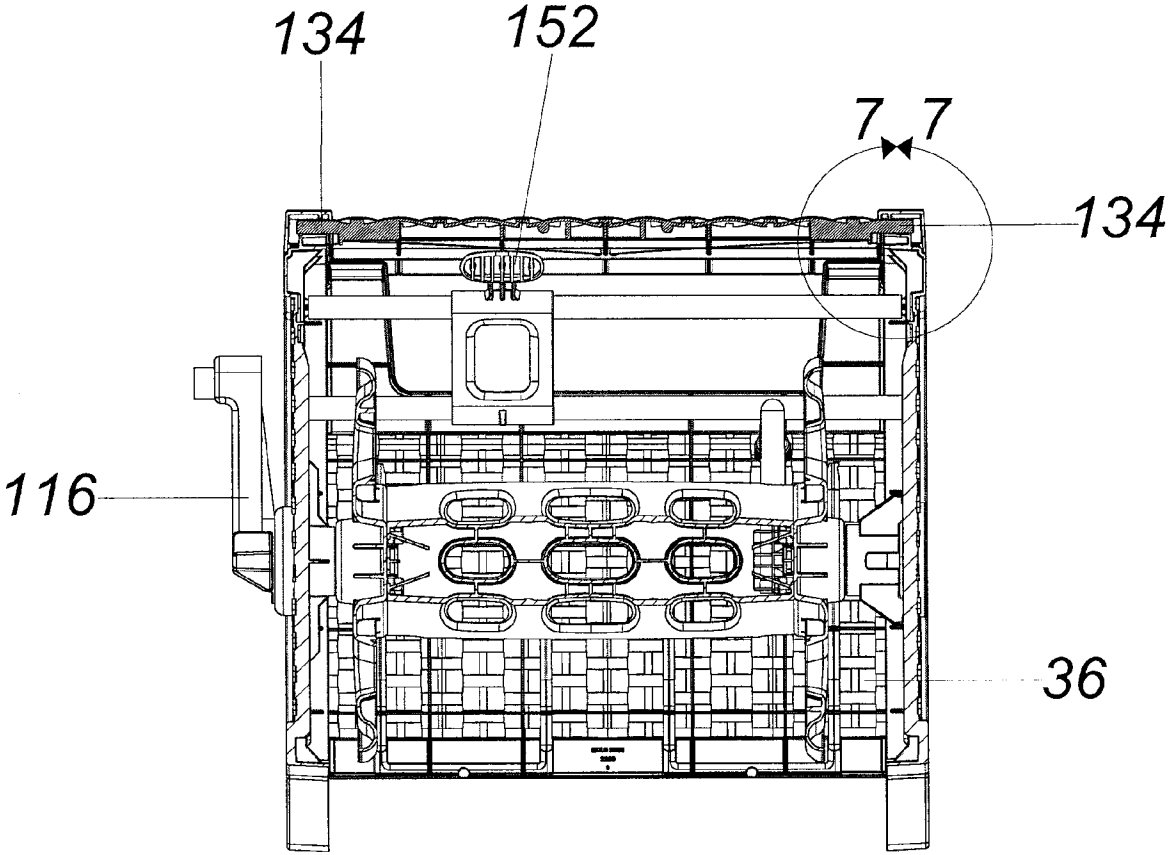
FIG. 6 is a sectional view of FIG. 2 along line 6-6.

FIGS. 1-14, which are now referenced, illustrate the present invention and the manner in which it is assembled. The hose reel enclosure 10 comprises a plurality of panels secured together and a cover assembly secured to the top portions of the panels. The panels include a front panel 12, a right side panel 14, a left side panel 16, and a back panel 18. A cover assembly 20 is secured to the top portions of the front, right, left, and back panels. The cover assembly comprises a stationary member 22 and a pivotal member 24. The pivotal member 24 is pivotally secured to the right and left side panels as will be described hereinafter. Referring now to FIG. 1, the front panel 12 includes a top edge 26, a bottom edge 28, a right side edge 30, a left side edge 32, a front surface 34, and a back surface 36 (FIG. 6). The right side panel 14 includes a top edge 38, a bottom edge 40, a right side edge 42, a left side edge 44, a front surface 46, and a back surface 48 (FIG. 3). The left side panel 16 includes a top edge 50, a bottom edge 52, a right side edge 54, a left side edge 56, a front surface 58 (FIG. 2), and a back surface 60. The back panel 18 includes a top edge 62, a bottom edge 64, a right side edge 66, a left side edge 68, a front surface 70 (FIG. 8), and a back surface 72.

Figure 8:
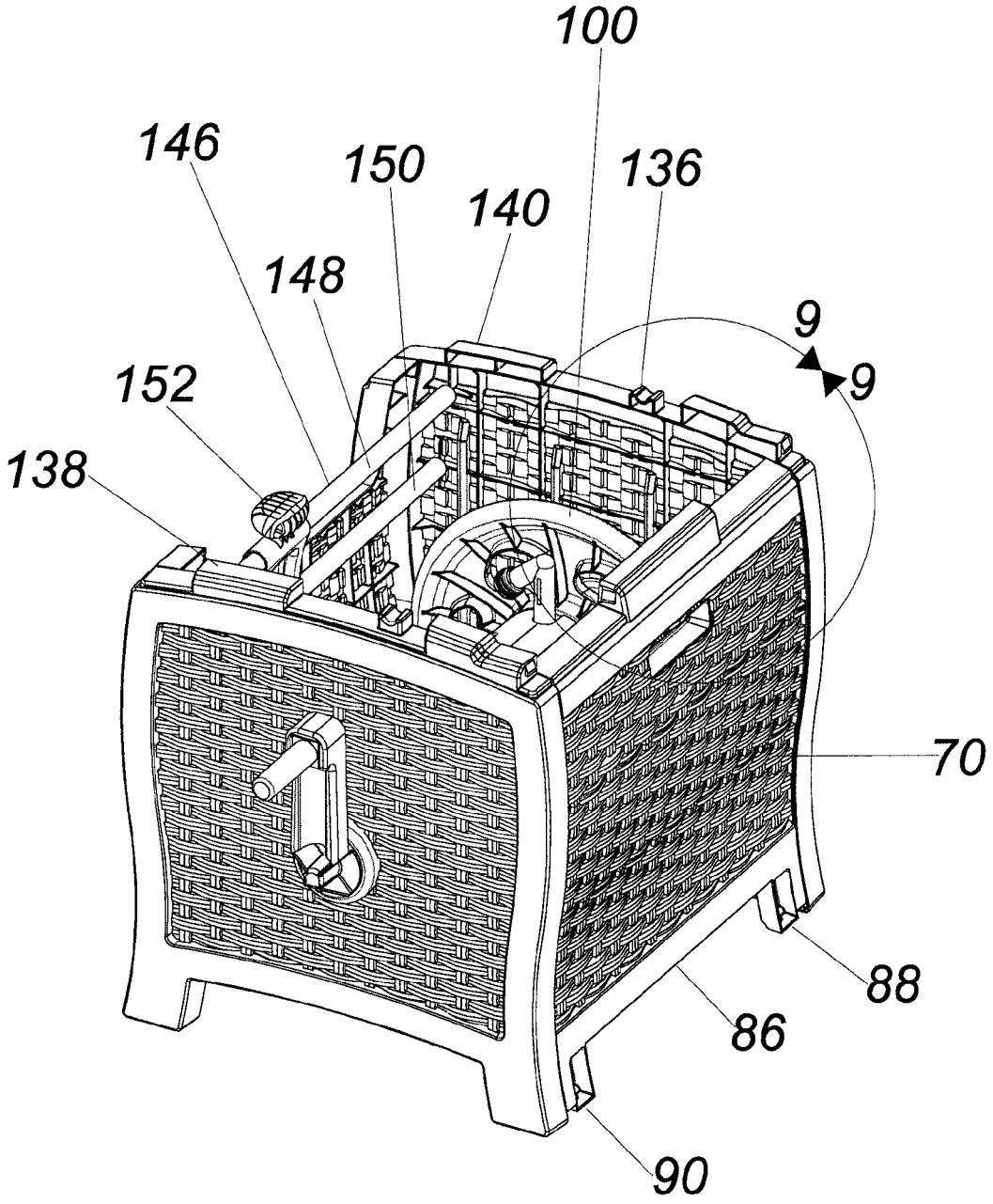
FIG. 8 is a rear perspective view of the present invention with the cover removed.
Figure 9:
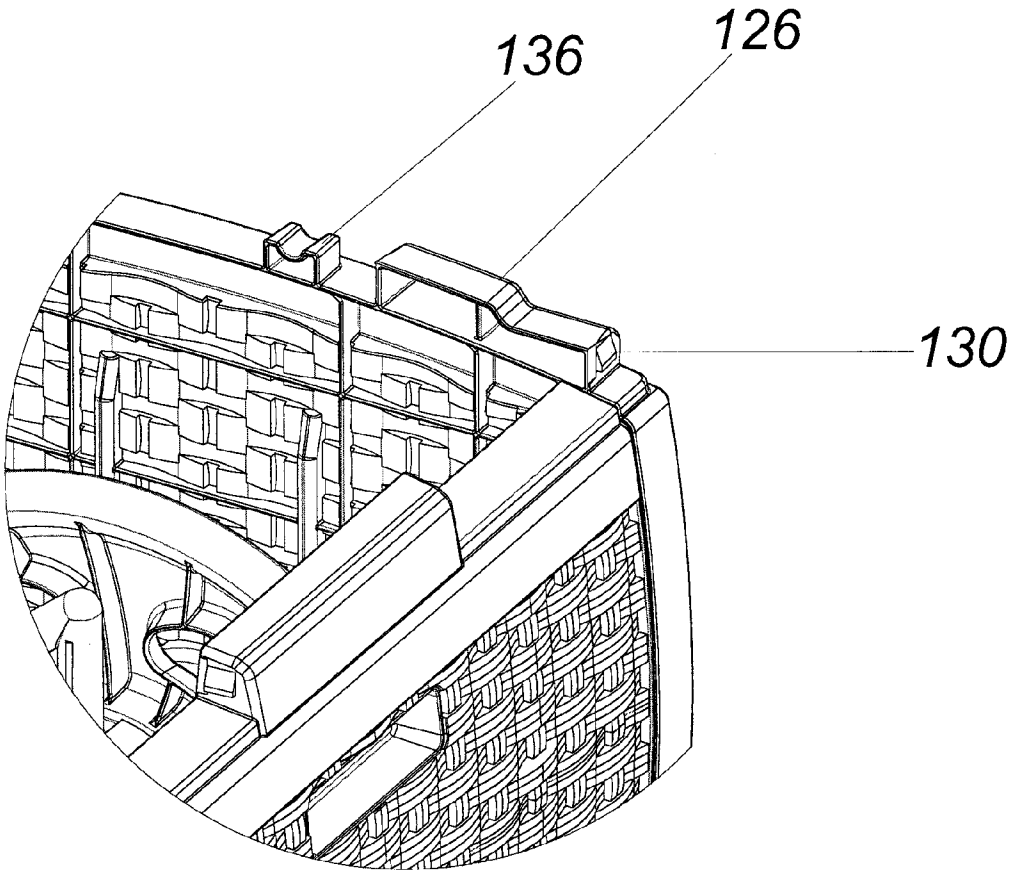
FIG. 9 is a cut-away view along line C-C in FIG. 8.
Figure 10:
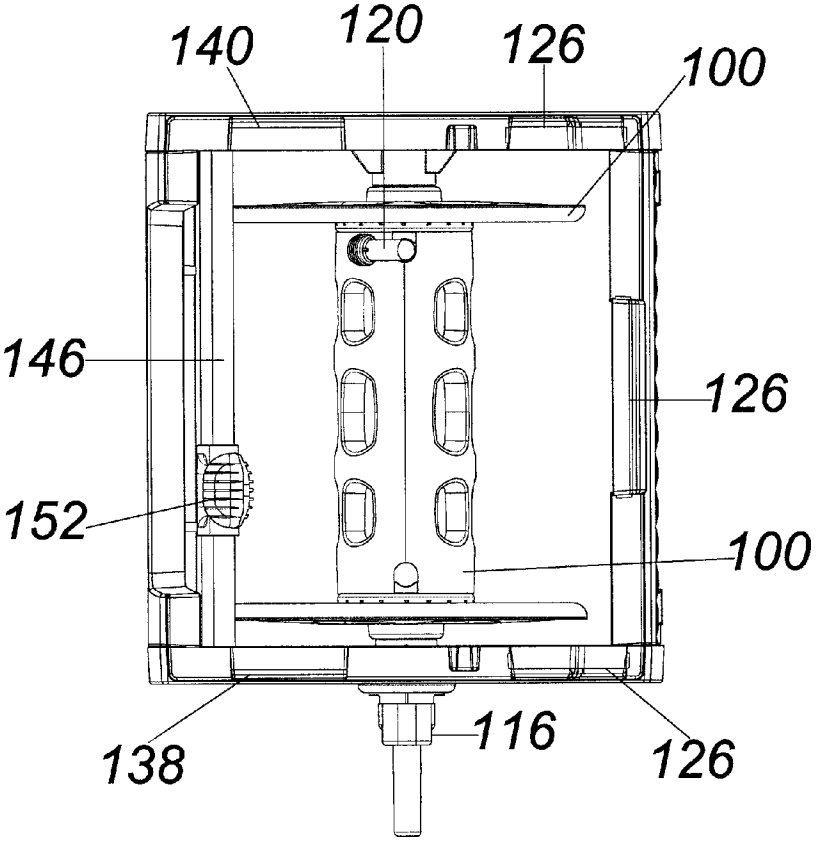
FIG. 10 is a top view of the present invention with the cover removed.

The right side panel 14 includes a recess 74 along a portion of the bottom edge 40. This recess forms two feet 76 and 78. The left side panel 16 includes a recess 80 along a portion of the bottom edge 52. This recess forms two feet 82 and 84. The back panel 18 includes a recess 86 (FIG. 8) along a portion of the bottom edge 64. This recess forms two feet 88 and 90 (FIG. 8). Feet 76, 78, 82, 84, 88, and 90 support enclosure 10 on a surface. Ribs 92 and gussets 94 (FIG. 3) are integrally formed on the back surfaces of the right, left, front, and back panels. These ribs and gussets add structural rigidity and strength to these panels.

The front and back panels include bosses 96 which are formed along both the right and left edges of these panels. In the preferred embodiment two bosses are formed along each edge. It is understood that as few as one boss and as many as can physically fit along an edge can be formed along each edge. The right and left panels include sockets 98 which are foil led along both the right and left edges of these panels. In the preferred embodiment two sockets are formed along each edge. It is understood that as few as one socket and as many as can physically fit along an edge can be formed along each edge. The only requirement is that for each boss there is a corresponding socket. The bosses 96 fit into and engage the sockets 98 so as to form an interlocking connection between the right, left, front, and back panels. Bosses 96 can be provided with spring lock fasteners 99. These spring lock fasteners 99 engage a portion of the socket 98 thus locking the boss and socket together. The spring lock fasteners enable the panels of the enclosure to be assembled without the use of tools. While the bosses are illustrated as including spring lock fasteners, the bosses can function without the spring lock fasteners.

A hose reel or spool 100 (FIGS. 1, 8, and 10) is rotatably mounted within enclosure 10. The hose reel or spool 100 includes a hub 102 which is formed from two sections 104 and 106. The two sections 104 and 106 are secured together to form the hub 102. The two sections 104 and 106 can be held together by components which frictionally engage each other or by additional fasteners. Two side plates or ends 108 and 110 are secured to each end of the hub 102. The side plates 108 and 110 guide and maintain a hose on the reel or spool 100. The side plates can be secured to the hub 102 by friction fit or with the use of additional fasteners. Side plate 108 includes a sleeve or connector 112 which is located at the center of the side plate. The sleeve or connector 112 rotates in a bearing 114 on the right side panel 14. A handle 116 includes a projection 118 at one end thereof. The projection is constructed and arranged to directly engage sleeve 112 so as to enable an individual to rotate the reel 100.

A water tube 120 is secured to side plate 110 and between sections 104 and 106 of hub 102. The water tube 120 rotates with the reel or spool 100. The water tube 120 passes through bearing 122 in the left side panel 16. A water fitting 124 is secured to the water tube 120 and holds the water tube onto left side panel 16 so as to enable the water tube 120 and reel 100 to rotate within the enclosure. The water fitting and the water tube snap together and can be assembled without the use of tools. A hose is connected to the water fitting 124 and provides water to a hose within the enclosure through the water tube 120. The water tube 120 and fitting 124 enable the reel or spool 100 to be rotated without having to disconnect the supply of water to the hose in the enclosure.

Figure 4:
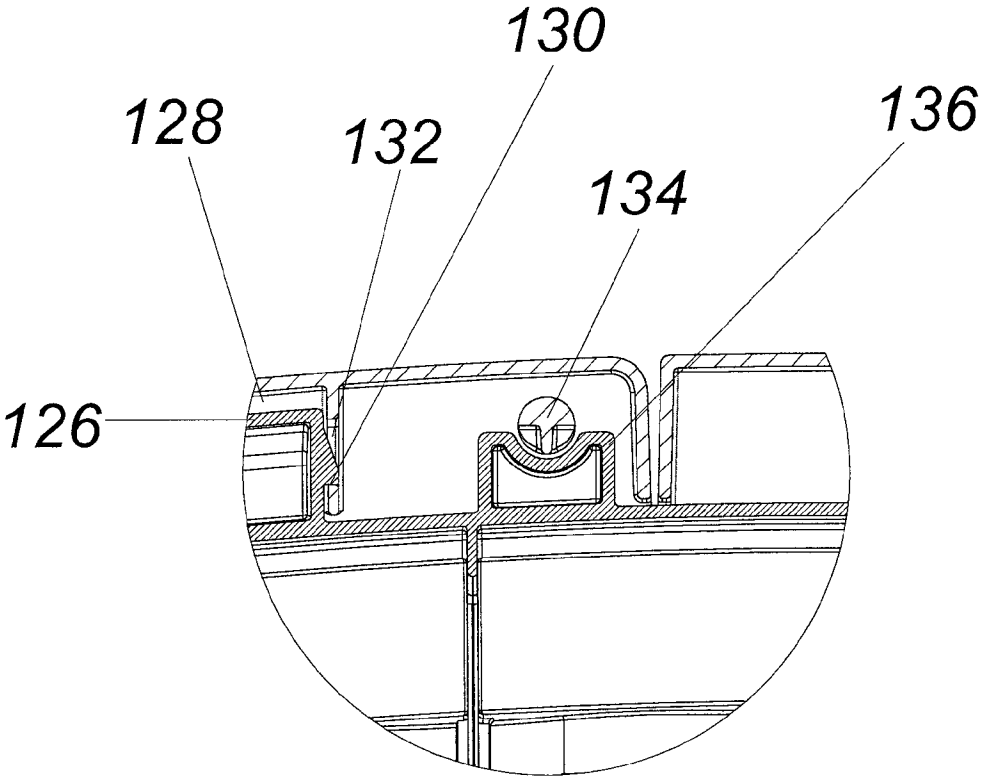
FIG. 4 is a cut-away view along line A-A in FIG. 3
Figure 5:
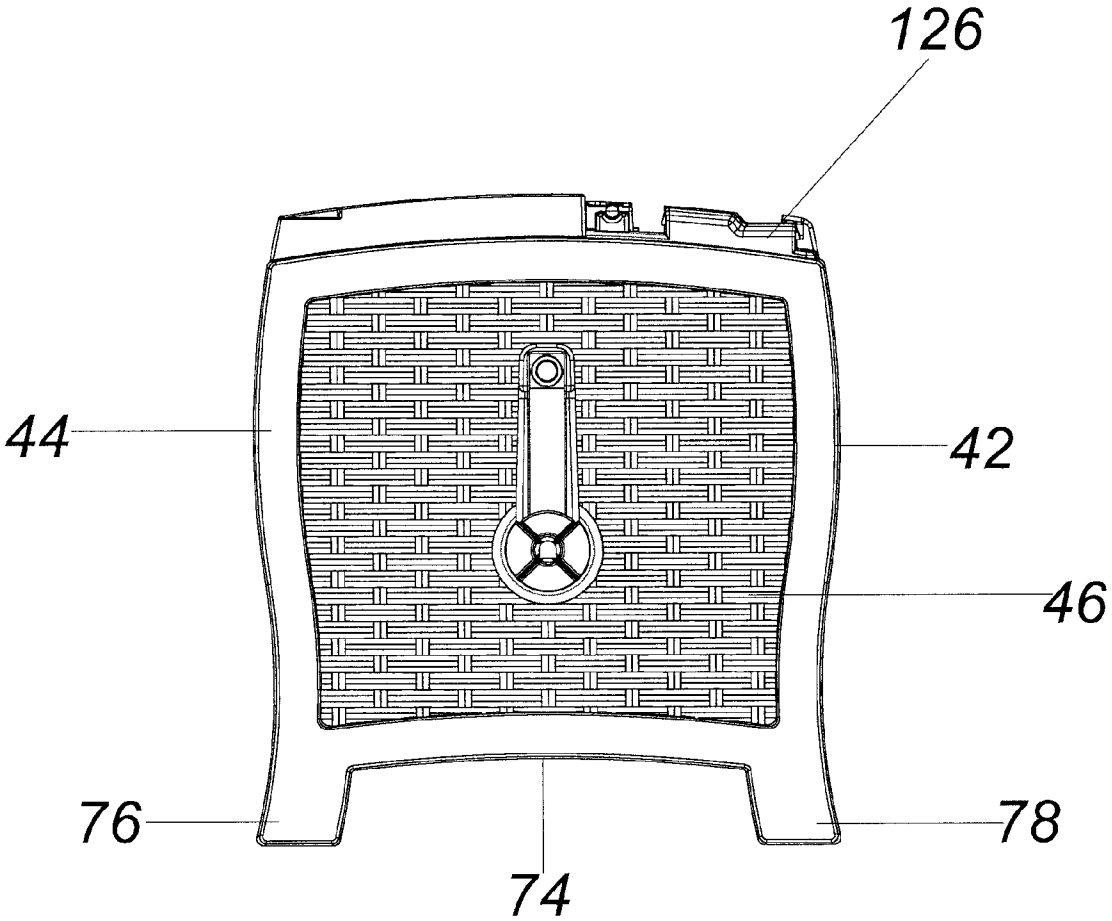
FIG. 5 is a side view of the present invention.
Figure 11:
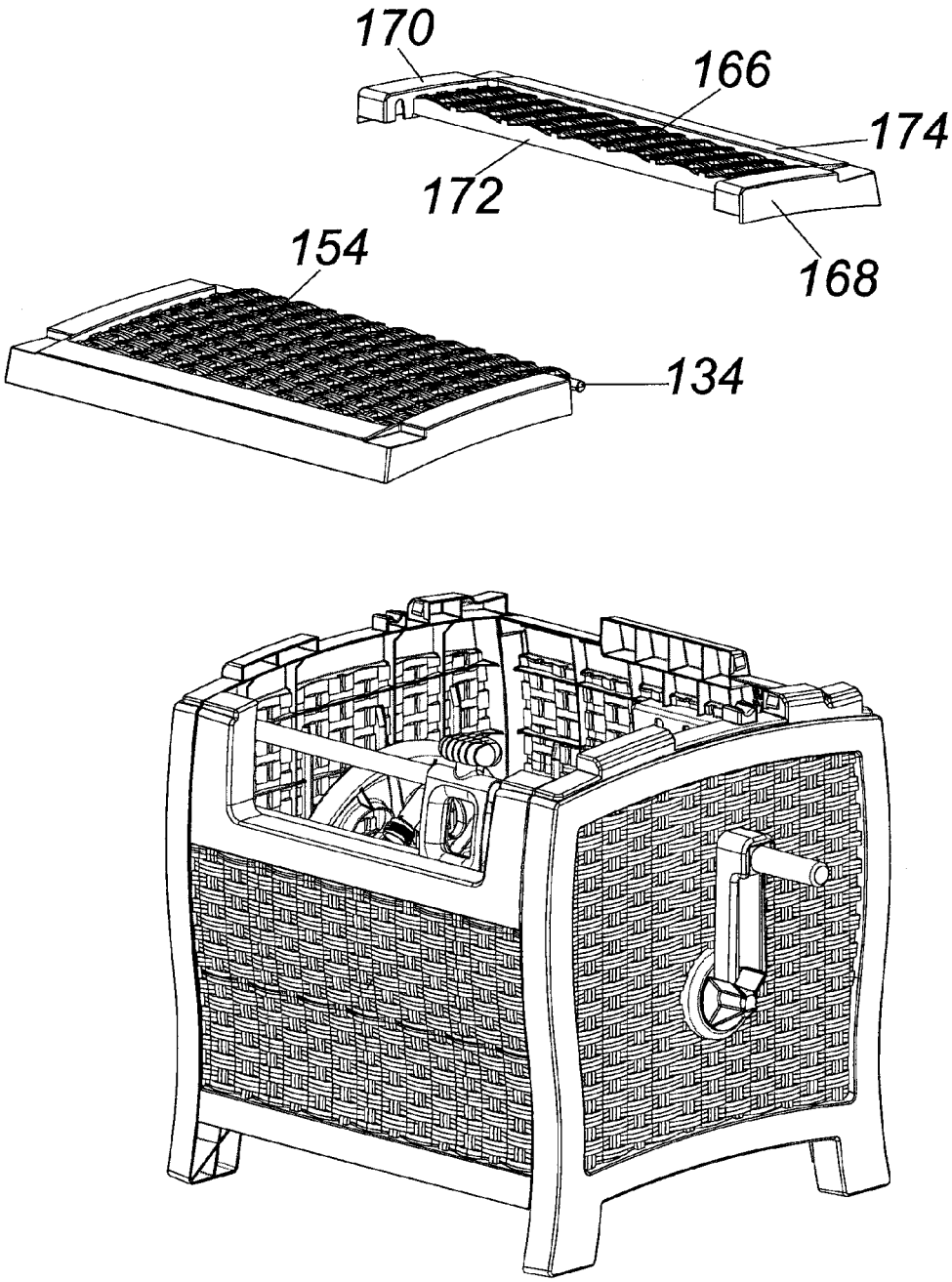
FIG. 11 is a front perspective view of the present invention with the two cover members separated from the enclosure.
Figure 12:
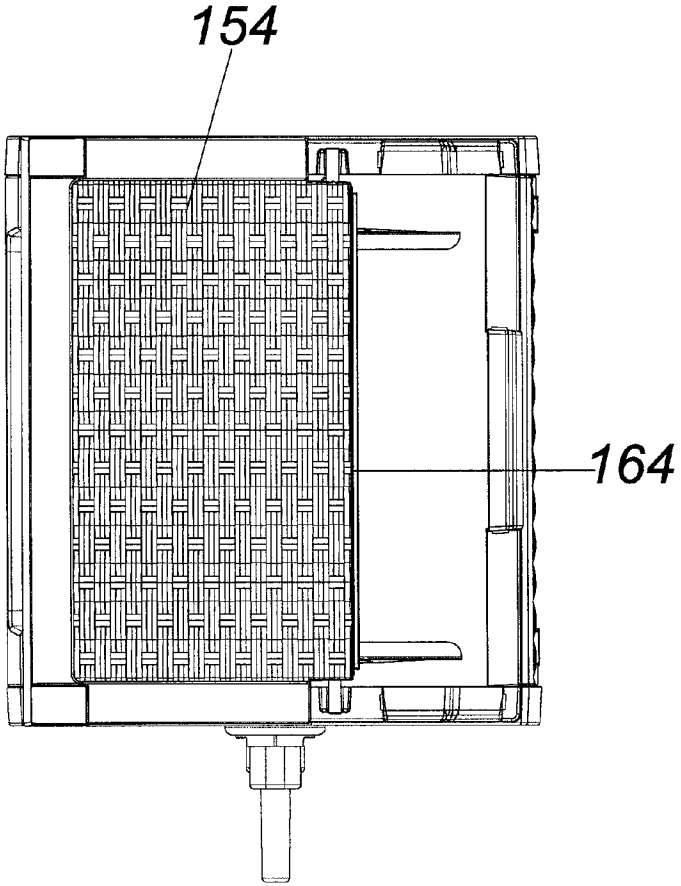
FIG. 12 is a top view of the present invention with only the hinged portion of the cover installed.
Figure 13:
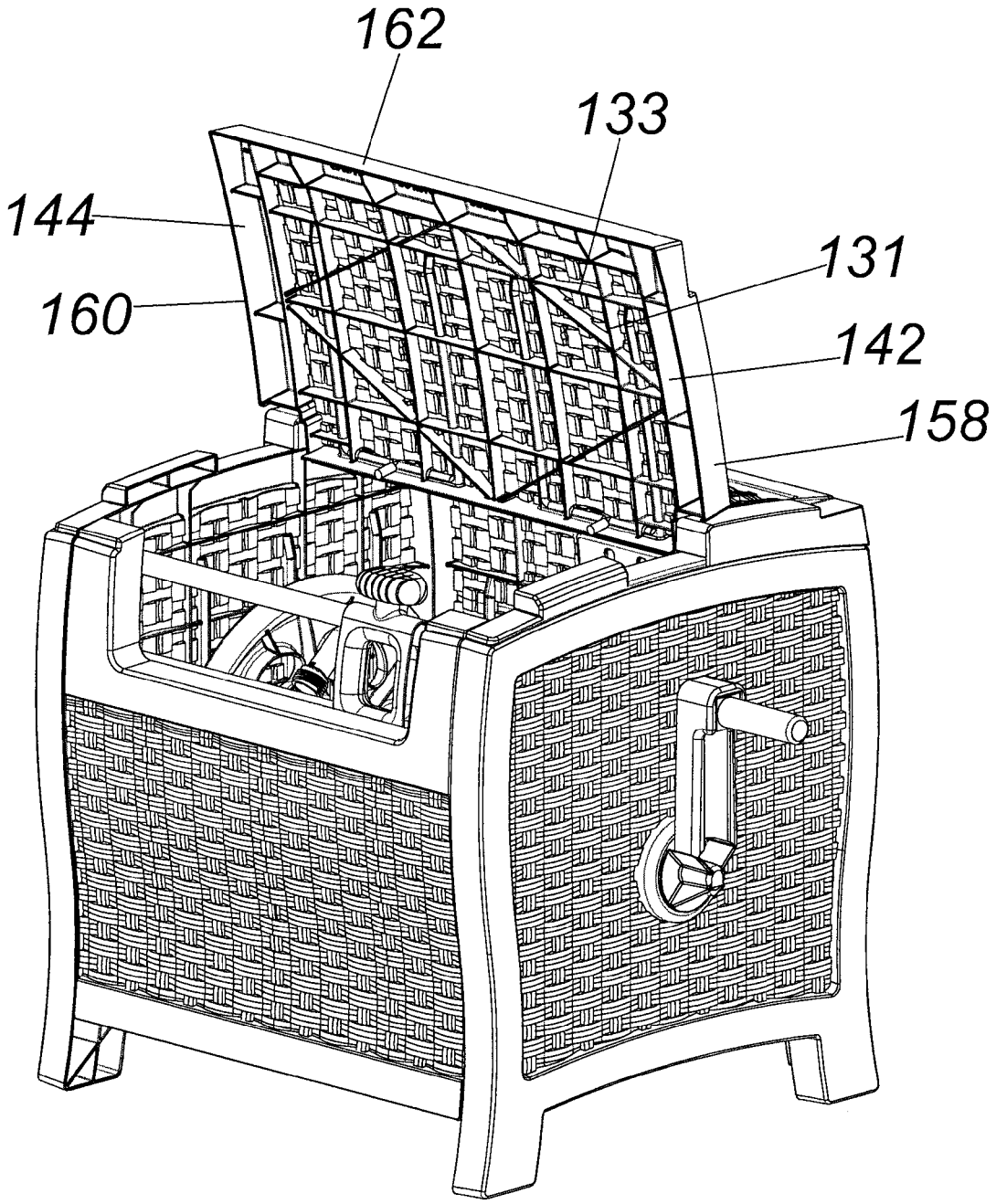
FIG. 13 is a front perspective view of the present invention with the hinged portion of the cover in a raised position.

A cover assembly 20 is secured to the top portions of the right, left, front, and back panels. The cover assembly includes a stationary member 22 and a pivotal member 24. The pivotal member 24 includes a top surface 154, an underside surface 156, a right edge 158, a left edge 160, a front edge 162 and a back edge 164 (FIGS. 11-13). The stationary member includes a top surface 166, an underside surface (not shown), a right edge 168, a left edge 170, a front edge 172 and a back edge 174 (FIG. 11). The pivotal member 24 is pivotally secured to the right and left side panels. The left, right, and back panels include bosses 126 located along the top edges of these panels (FIGS. 1 and 3). The stationary member 22 of the cover assembly includes sockets 128 located along the outer perimeter edges. These sockets 128 are located so as to engage corresponding bosses 126, as illustrated in FIGS. 3 and 4. The bosses 126 can be provided with spring catches 130 (FIG. 4). The spring catches 130 releasably engage apertures 132 in sockets 128 (FIG. 4). The spring catches 130 enable the stationary member 22 to be installed onto the enclosure without the use of tools. Ribs 131 and gussets 133 (FIG. 13) are integrally foil led on the back surfaces of the stationary member 22 and pivotal member 24. These ribs and gussets add structural rigidity and strength to these members.

Figure 7:
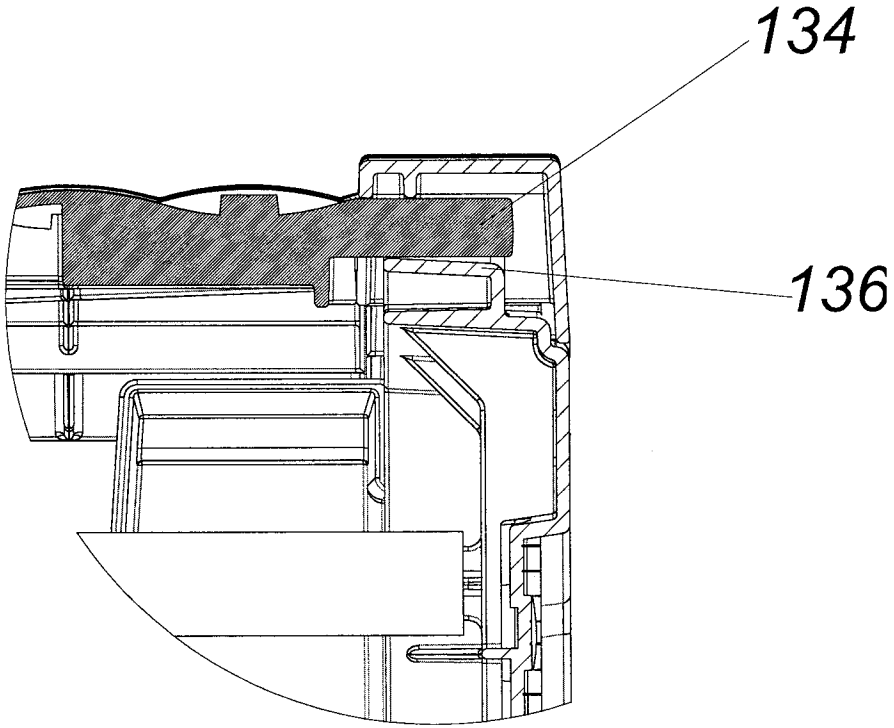
FIG. 7 is a cut-away view along line B-B in FIG. 6.

The pivotal member 24 of the cover assembly includes a plurality of pins or hinge members 134 formed on a rear portion of the pivotal member (FIGS. 6 and 7). In the preferred embodiment there are two pins or pivot members 134. Each of the pins 134 is located adjacent a rear corner portion of the pivotal member 24. The pins 134 are set into or rest on a saddle member 136. There is a saddle member 136 foamed along a top edge of each of the right side panel and the left side panel, as illustrated in FIGS. 4, 7, 8, and 9. The pins 134 allow the pivotal member of the cover to readily move between a closed position, illustrated in FIGS. 2 and 12 and an open position, illustrated in FIG. 13. The open position of the pivotal member 24 permits access to the interior of the hose enclosure. This enables an individual to connect and disconnect a hose from the water tube 120. It also enables an individual to make adjustments to a hose on the hose reel, should adjustments become necessary. For example, if the hose bunches up at one end of the reel rather than being evenly spread along the reel.

The top edge of the right side panel includes a boss 138 and the top edge of the left side panel includes a boss 140 (FIG. 8). These bosses engage corresponding sockets 142 and 144 located on the underside edges of the pivotal member 24 (FIG. 13). The interaction between the bosses 138, 140 and the sockets 142, 144 provides structural support to the enclosure by securing the cover member to the side panels.

A hose guide 146 is located within the enclosure 10 at an upper front portion thereof. The hose guide 146 includes two rails 148, 150 and a guide member 152 (FIG. 8). The two rails 146 and 148 are secured between the right and left side panels 14 and 16. The guide member 152 moves back and forth along these rails and guides a hose evenly onto the hose reel 100 as the hose is wound onto the reel 100. The hose passes from the guide member 152 through an aperture 156 in the front panel 12. This construction enables a hose to be played out from the enclosure and wound onto the reel within the enclosure while the cover remains closed.

The front surfaces 34, 46, 58, and 70 of the front panel 12, right side panel 14, left side panel 16, and back panel 18 include a decorative pattern formed thereon. In the preferred embodiment the pattern is wicker. Any type of decorative pattern can be employed. The pattern is integrally molded onto the panels when the panels are formed. The top surfaces of the stationary member and pivotal members of the cover assembly also include a decorative pattern formed thereon. This pattern is the same as the pattern on the right, left, front and back panels.

Figure 14:
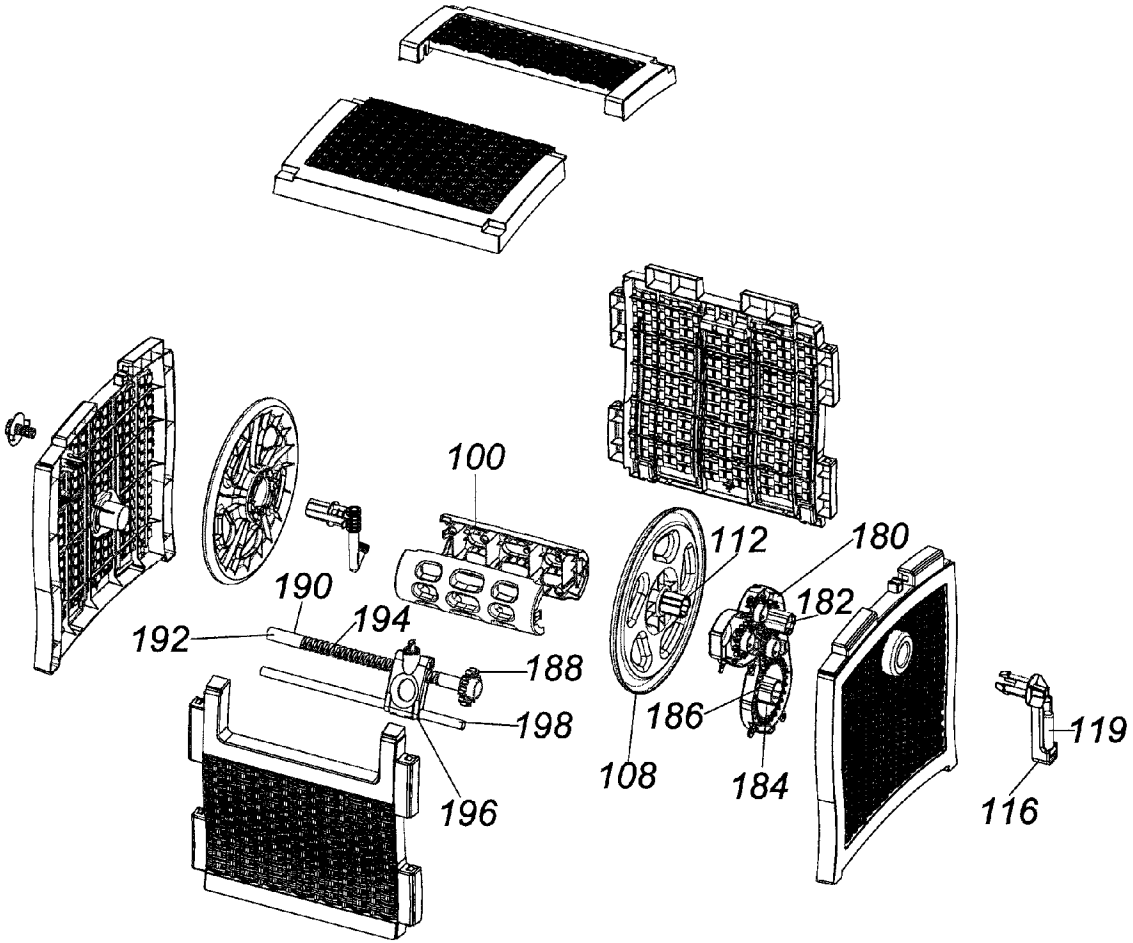
FIG. 14 is an exploded view of another embodiment of the present invention.

FIG. 14 illustrates another embodiment of the present invention. In this embodiment the handle 116 is not directly connected to the sleeve or connector 112 on the side plate 108 of the hose reel. A gear assembly 180 is disposed between the handle 116 and the sleeve or connector 112. The handle 116 is releasably secured to a sleeve or connector 182 on the gear assembly 180. The sleeve or connector 112 of the side plate 108 is releasably connected to a connector or coupling 184 of the gear assembly. The sleeve 182 rotates and drives the coupling 184 to rotate through a plurality of gears 186. The size and number of gears 186 can be selected so as to permit the hose reel 100 to turn faster, slower or at the same speed as the rotation of handle 116. The gears 186 can also be selected so as to require less effort to turn the hose reel by having the handle 116 rotate more times that the hose reel 100. The handle 116 also includes a member 119 which can be pivoted between a use position, FIG. 1 and a stored position, FIG. 14.

The gear assembly 180 also drives a gear 188 on the hose guide 190. The gear 188 drives the upper rail 192 of the hose guide. The upper rail 192 includes a plurality of elliptical slots or grooves 194. A guide member 196 is connected to and is driven by these slots or grooves 194. The guide member moves back and forth along rails 192 and 198 to guide a hose evenly onto or from reel 100.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A hose reel enclosure comprising:

a right side panel for enclosing a right side of said hose reel enclosure;

a left side panel for enclosing a left side of said hose reel enclosure;

a front panel for enclosing a front of said hose reel enclosure;

a back panel for enclosing a back of said hose reel enclosure;

a cover assembly for enclosing a top of said hose reel assembly, said cover assembly including a stationary member and a pivotal member, said stationary member including at least one of a socket or a boss integrally formed along a right edge, a left edge or a back edge of said stationary member, said at least one socket or boss being mechanically connected to an opposing boss or socket formed on a top edge of said right side panel, said back panel or said left side panel, said at least one boss including at least one spring catch positioned to engage an aperture located within said at least one socket, whereby said stationary member is fixed in position and providing structural support to said right side panel, said left side panel, and said back panel, said pivotal member having a first pin integrally formed along a right edge of said pivotal member and a second pin integrally formed along a left edge of said pivotal member, said first and second pin secured between said stationary member and said right side panel and said left side panel, said pivotal member being pivoted between a closed position and an open position, said pivotal member engaging said right side panel and said left side panel when in said closed position, said pivotal member permitting access to an interior of said hose reel enclosure when in said open position through said top of said hose reel enclosure;

said right side panel, said left side panel, said front panel and said back panel are provided with at least one of a socket or a boss integrally formed thereon;

said sockets and said bosses are constructed and arranged to interlockingly engage each other in a mechanically secure connection therebetween, each said boss includes a spring catch integrally formed thereto and is inserted into each said panel socket in a substantially perpendicular direction such that, said right side panel, said left side panel, said front panel and said back panel are assembled in a substantially perpendicular relationship to each other without any longitudinal or lateral movement with respect to each other, each said spring catch is constructed and arranged to cooperate with at least one aperture formed into each said socket for interlocking engagement therewith;

a hose reel rotatably secured between said right side panel and said left side panel, access to said hose reel is granted when said pivotal member of said cover assembly is in said open position;

whereby said left side panel, said right side panel, said front panel and said back panel are constructed and arranged for snap-together assembly without additional fasteners.

2. The hose reel enclosure of claim 1 wherein the at least one socket or boss of said stationary member of said cover assembly includes a plurality of sockets integrally formed in said right edge, said left edge and said back edge of said stationary member, said plurality of sockets are mechanically connected to a plurality of bosses comprising the at least one boss or socket on said top edge of said right side panel, said back panel and said left side panel, whereby said right side panel, said left side panel, and said back panel are secured to each other without any longitudinal or lateral movement with respect to each other.

3. The hose reel enclosure of claim 1 including;

at least one saddle formed along said top edge of said right side panel for receipt of said first pin and at least one saddle formed along said top edge of said left side panel for receipt of said second pin;

said pins on said pivotal member engaging said saddles whereby said pivotal member is operatively moved between said closed position and said open position.

4. The hose reel enclosure of claim 3 wherein said pivotal member of said cover assembly can be readily removed from said hose reel enclosure without the use of any tools.

5. The hose reel enclosure of claim 3 including an aperture in an upper portion of said front panel, said aperture being constructed and arranged to allow the passage of a hose therethrough when said pivotal member of said cover assembly is in said closed position.

6. The hose reel enclosure of claim 1 wherein said pivotal member of said cover assembly includes a plurality of sockets integrally formed in said right edge and said left edge of said pivotal member, said plurality of sockets of said pivotal member are mechanically connected to a plurality of bosses comprising said at least one boss or socket formed on said top edge of said right side panel and said left side panel.

7. The hose reel assembly of claim 1 including a decorative pattern integrally formed on a front surface of said right side panel, said left side panel, said front panel, and said back panel;

said decorative pattern is also integrally formed on a top surface of said stationary member and said pivotal member of said cover assembly.

8. The hose reel enclosure of claim 7 wherein said decorative pattern integrally formed on said front surface of said right side panel, said left side panel, said front panel, said back panel, and on said top surface of said stationary member and said pivotal member of said cover assembly is a simulated wicker pattern.

9. The hose reel enclosure of claim 1 including a handle secured directly to a connector on said hose reel, said connector is rotatably mounted in a bearing in one of said right side panel and said left side panel.

10. The hose reel enclosure of claim 1 including a water tube releasably secured to said hose reel;

a water fitting releasably secured to said water tube, said water tube providing a fluid connection for water to pass into a hose which can be secured to said reel, said water fitting and said water tube being rotatably mounted in a bearing in one of said right side panel and said left side panel.

11. The hose reel enclosure of claim 1 including a hose guide, said hose guide secured to and between said right side panel and said left side panel, said hose guide enabling a hose to be evenly placed onto said reel.

12. The hose reel enclosure of claim 1 including a handle secured to a first coupling on a gear assembly, said first coupling is rotatably mounted in a bearing in one of said right side panel and said left side panel;

a connector on said hose reel secured to a second coupling on said gear assembly, whereby the number of rotations of said hose reel compared to the number of rotations of said handle is dependent on the gears in said gear assembly.

13. The hose reel enclosure of claim 12 including a hose guide, said hose guide secured to and between said right side panel and said left side panel;

a gear operatively secured to said hose guide, said gear being operatively secured to said gear assembly whereby rotation of said handle operates said hose guide enabling a hose to be evenly placed onto said reel.

14. The hose reel enclosure of claim 1 including a plurality of feet integrally formed along a bottom portion of said right side panel, said left side panel, and said back panel, said plurality of feet supporting said hose reel enclosure on a surface.

15. The hose reel enclosure of claim 1 including an aperture in an upper portion of said front panel, said aperture being constructed and arranged to allow the passage of a hose therethrough when said pivotal member of said cover assembly is in said closed position.

* * * * *